US011391477B2

(12) United States Patent
Chen et al.

(10) Patent No.: US 11,391,477 B2
(45) Date of Patent: Jul. 19, 2022

(54) METHOD AND DEVICE FOR CONTROLLING SELF-CLEANING OF AIR CONDITIONER

(71) Applicants: Qingdao Haier Air Conditioner General Corp., Ltd., Shandong (CN); Chongqing Haier Air Conditioner Corp., Ltd., Chongqing (CN)

(72) Inventors: Dong Chen, Shandong (CN); Yongfu Cheng, Shandong (CN); Shifang Song, Shandong (CN)

(73) Assignee: CHONGQING HAIER AIR CONDITIONER CORP., LTD., Chongqing (CN)

( * ) Notice: Subject to any disclaimer, the term of this patent is extended or adjusted under 35 U.S.C. 154(b) by 16 days.

(21) Appl. No.: 16/461,715

(22) PCT Filed: Mar. 2, 2018

(86) PCT No.: PCT/CN2018/077848
§ 371 (c)(1),
(2) Date: May 16, 2019

(87) PCT Pub. No.: WO2018/177069
PCT Pub. Date: Oct. 4, 2018

(65) Prior Publication Data

US 2019/0360709 A1 Nov. 28, 2019

(30) Foreign Application Priority Data

Apr. 1, 2017 (CN) ..... 201710214488.1

(51) Int. Cl.
*F24F 11/30* (2018.01)
*F24F 11/62* (2018.01)
(Continued)

(52) U.S. Cl.
CPC ..... *F24F 11/30* (2018.01); *F24F 11/62* (2018.01); *F24F 11/52* (2018.01);
(Continued)

(58) Field of Classification Search
CPC ..... F24F 11/30; F24F 11/62; F24F 2110/50; F24F 2140/12; F24F 11/52;
(Continued)

(56) References Cited

U.S. PATENT DOCUMENTS

2010/0294134 A1* 11/2010 Yokomizo ..... B01D 46/0065 96/405
2012/0323375 A1* 12/2012 Dean-Hendricks ..... F24F 8/10 700/276
2017/0115025 A1* 4/2017 Mowris ..... F24H 9/2064

FOREIGN PATENT DOCUMENTS

CN 1899624 A 1/2007
CN 101057110 A 10/2007
(Continued)

OTHER PUBLICATIONS

Media Refrigeration Equipment Co Ltd, Cleaning reminding method and system of filter screen of air conditioner, Feb. 2015, pp. 1-10 (Year: 2015).*

(Continued)

*Primary Examiner* — Thomas C Lee
*Assistant Examiner* — Michael Tang
(74) *Attorney, Agent, or Firm* — Marshall, Gerstein & Borun LLP

(57) ABSTRACT

A method and a device for controlling self-cleaning of an air conditioner are provided. The method comprises: acquiring operation duration, operation status parameters and air quality parameters of an air conditioner; determining an equivalent operation duration for the air conditioner according to the operation duration, operation status parameters and air
(Continued)

quality parameters of the air conditioner; and controlling the air conditioner to perform self-cleaning when the equivalent operation duration for the air conditioner is greater than a cleaning duration threshold value. The method may prevent a problem of delayed cleaning or premature cleaning of the air conditioner which is caused by pre-estimating a self-cleaning frequency merely according to one variable which is a booting duration.

21 Claims, 4 Drawing Sheets

(51) Int. Cl.
*F24F 110/50* (2018.01)
*F24F 140/12* (2018.01)
*F24F 11/52* (2018.01)

(52) U.S. Cl.
CPC ..... *F24F 2110/50* (2018.01); *F24F 2140/12* (2018.01); *F24F 2221/22* (2013.01)

(58) Field of Classification Search
CPC ..... F24F 2221/22; F24F 8/90; F24F 2110/52; F24F 11/39; Y02B 30/70
See application file for complete search history.

(56) References Cited

FOREIGN PATENT DOCUMENTS

| | | | | |
|---|---|---|---|---|
| CN | 102095232 | A | | 6/2011 |
| CN | 102878640 | A | | 1/2013 |
| CN | 102938023 | A | | 2/2013 |
| CN | 103994559 | A | | 8/2014 |
| CN | 104180474 | A | | 12/2014 |
| CN | 104374046 | A | | 2/2015 |
| CN | 104841214 | A | | 8/2015 |
| CN | 105222289 | A | | 1/2016 |
| CN | 106247531 | A | | 12/2016 |
| CN | 106247532 | A | | 12/2016 |
| CN | 106352447 | A | | 1/2017 |
| CN | 106403163 | A | | 2/2017 |
| CN | 106969467 | A | | 7/2017 |
| EP | 2072927 | A1 | | 6/2009 |
| EP | 2246637 | A1 | | 11/2010 |
| JP | H102592 | A | | 1/1998 |
| JP | 2000210518 | A | * | 8/2000 |
| JP | 2004239449 | A | | 8/2004 |
| JP | 5074225 | B2 | * | 11/2012 |
| KR | 20080058732 | A | | 6/2008 |

OTHER PUBLICATIONS

Fujitsu General Ltd, Air-Conditioner Control Method, Aug. 2003, pp. 1-17 (Year: 2003).*
International Search Report from PCT/CN2018/077848 dated Jun. 4, 2018.
Office Action from Chinese Application No. 201710214488.1 dated Jul. 15, 2019.
Search Report from European Application No. 18776745.4 dated Dec. 3, 2019.
Office Action from Chinese Application No. 2019100902332810 dated Oct. 12, 2019.
Office Action from Chinese Application No. 201710214488.1 dated Mar. 2, 2020.
Office Action from Chinese Application No. 201710214488.1 dated Mar. 11, 2019.
Written Opinion from International Application No. PCT/CN2018/077848 dated Jun. 4, 2018.

* cited by examiner

METHOD AND DEVICE FOR CONTROLLING SELF-CLEANING OF AIR CONDITIONER

The present application is proposed based on China patent application No. CN201710214488.1, filed on Apr. 1, 2017, and claims priority to the China patent application, the entire contents of which are hereby incorporated by reference.

TECHNICAL FIELD

The present disclosure relates to the technical field of air conditioning, and particularly relates to a method and a device for controlling self-cleaning of an air conditioner.

BACKGROUND

Air conditioners have become increasingly popular in people's daily life, and consumers have increasingly high requirements for functions of the air conditioners. After the air conditioners are placed or used for a long time, heat exchangers or filter meshes of the air conditioners tend to accumulate a large amount of dust, thereby causing degradation in performance of the air conditioners. As for the existing air conditioners, whether the heat exchangers or the filter meshes need to be cleaned is estimated merely according to one variable which is a booting duration of the air conditioners. However, other factors such as air quality and air conditioning operation modes during use of the air conditioners have great influences on the dust accumulation speed of the heat exchangers or the filter meshes, so that the air conditioners cannot be cleaned at a proper time in a simplified control mode in the related art.

SUMMARY

Embodiments of the present disclosure provide a method and a device for controlling self-cleaning of an air conditioner, so as to solve a problem that self-cleaning of the air conditioner is judged merely according to one variable which is a booting duration of the air conditioner in the related art. In order to basically understand some aspects of the disclosed embodiments, a brief summary is given below. The summary is not a general comment, nor tends to determine key/critical constituent elements or describe a protection scope of these embodiments, and only aims to present some concepts in a simplified form as an introduction of the following detailed description.

An objective of the present disclosure is to provide a method for controlling self-cleaning of the air conditioner.

In some exemplary embodiments, the method for controlling self-cleaning of the air conditioner includes:

acquiring operation duration, operation status parameters and air quality parameters of the air conditioner;

determining an equivalent operation duration of the air conditioner according to the operation duration, the operation status parameters and the air quality parameters of the air conditioner; and controlling the air conditioner to perform self-cleaning when the equivalent operation duration of the air conditioner is greater than a cleaning duration threshold value.

In some illustrative embodiments, the operation status parameters include gear time coefficients of a plurality of wind speed gears for operation of the air conditioner.

In some illustrative embodiments, the air quality parameters include an air time coefficient corresponding to an indoor air quality level.

In some illustrative embodiments, the operation duration includes operation durations corresponding to various wind speed gears.

In some illustrative embodiments, the wind speed gears include high, medium and low gears. The step of determining the equivalent operation duration of the air conditioner according to the operation duration, the operation status parameters and the air quality parameters of the air conditioner includes:

determining the equivalent operation duration T of the air conditioner according to the following formula:

$$T=\tau*(\alpha*t_H+\beta*t_M+\gamma*t_L),$$

where $\tau$ is the air time coefficient corresponding to the air quality level; $\alpha$, $\beta$ and $\gamma$ are respectively the gear time coefficients when the wind speed gears are high, medium and low; and $t_H$, $t_M$ and $t_L$ are respectively the operation durations when the wind speed gears are high, medium and low.

In some illustrative embodiments, the step of acquiring the air quality parameters includes:

monitoring an operation status of the air conditioner;

acquiring an outdoor air quality in a monitoring time period; and determining an indoor air quality parameter according to the outdoor air quality.

Another objective of the present disclosure is to provide a device for controlling self-cleaning of an air conditioner.

In some exemplary embodiments, a device for controlling self-cleaning of an air conditioner includes:

a signal receiver, configured to acquire an operation duration, operation status parameters and air quality parameters of the air conditioner;

a processor, configured to determine an equivalent operation duration of the air conditioner according to the operation duration, operation status parameters and air quality parameters of the air conditioner, and control the air conditioner to perform self-cleaning when the equivalent operation duration of the air conditioner is greater than a cleaning duration threshold value.

In some illustrative embodiments, the operation status parameters include gear time coefficients of a plurality of wind speed gears for operation of the air conditioner.

In some illustrative embodiments, the air quality parameters include an air time coefficient corresponding to an indoor air quality level.

In some illustrative embodiments, the operation duration includes operation durations corresponding to various wind speed gears.

In some illustrative embodiments, the wind speed gears include high, medium and low gears.

The processor is further configured to calculate the equivalent operation duration T of the air conditioner according to the following formula:

$$T=\tau*(\alpha*t_H+\beta*t_M+\gamma*t_L),$$

where $\tau$ is the air time coefficient corresponding to the air quality level; $\alpha$, $\beta$ and $\gamma$ are respectively the gear time coefficients when the wind speed gears are high, medium and low; and $t_H$, $t_M$ and $t_L$ are respectively the operation durations when the wind speed gears are high, medium and low.

In some illustrative embodiments:

the processor is further configured to monitor an operation status of the air conditioner, acquire an outdoor air quality in a monitoring time period, and determine the air quality parameter according to the outdoor air quality.

A technical solution provided by the embodiments of the present disclosure may include the following beneficial effects:

Three important parameters including the operation duration, the operation status parameters and the air quality parameters of the air conditioner are introduced in a process of judging whether to clean, thereby avoiding a problem of delayed cleaning or premature cleaning of the air conditioner which is caused by estimating a self-cleaning frequency merely according to one variable which is a booting duration in a traditional solution, improving use efficiency of the air conditioner, enhancing user experience, and making cleaning solutions smarter.

It should be understood that the above general description and the following detailed description are merely exemplary and illustrative and not restrictive to the present disclosure.

BRIEF DESCRIPTION OF THE DRAWINGS

The accompanying drawings herein, which are incorporated in the description and constitute a part of the description, illustrate embodiments consistent with the present disclosure and serve to explain principles of the present disclosure together with the description.

DETAILED DESCRIPTION

Figure 1:
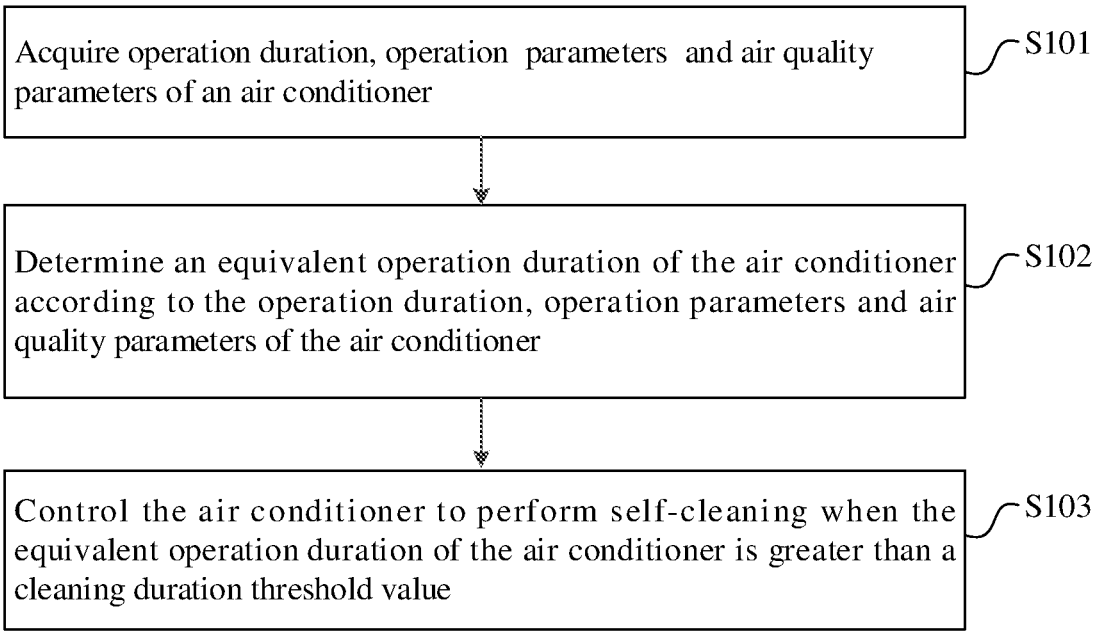
FIG. 1 is a flow chart of a method for controlling self-cleaning of an air conditioner according to one exemplary embodiment.

The following description and accompanying drawings fully illustrate specific embodiments of the present disclosure so that those skilled in the art can practice the specific embodiments. The embodiments only represent possible variations. Individual components and functions are optional unless explicitly required, and a sequence of operations is variable. Parts and features of some embodiments may be included in or substituted for parts and features of other embodiments. A scope of the embodiments of the present disclosure includes a full scope of claims and available equivalents of the claims. In this description, various embodiments may be individually or generally represented by a term "disclosure" for convenience only. If more than one disclosure is actually disclosed, the scope of the application is not automatically limited to any individual disclosure or inventive concept. In this description, relational terms such as first, second, etc. are only used to distinguish one entity or operation from another entity or operation, and do not require or imply any actual relationship or order among these entities or operations. Moreover, the terms such as "include", "contain" or any other variation thereof are intended to cover non-exclusive inclusions, such that a process, method or apparatus including a series of elements not only includes those elements, but also includes other elements not explicitly listed. Each embodiment herein is described in a progressive manner, and focuses on illustrating differences from other embodiments. Same and similar parts of the various embodiments can be referred to each other. Structures, products and the like disclosed in the embodiments correspond to the parts disclosed in the embodiments, and thus are described relatively simply; and the relevant parts refer to the descriptions of the method.

At present, a method for controlling self-cleaning of an air conditioner is provided. A main idea of the solution is to introduce relevant parameters of air conditioner operation conditions and indoor air quality on a basis that the existing air conditioner merely relies on a single variable of air conditioner booting duration to estimate whether a heat exchanger or filter mesh needs self-cleaning, obtain an optimized equivalent operation duration of the air conditioner through an algorithm, and then judge whether the air conditioner needs self-cleaning. This mode can judge dust accumulation of the heat exchanger or filter mesh of the air conditioner more closely to actual usage of the air conditioner so that the self-cleaning is smarter.

In the present disclosure, the operation duration is an actual operation duration of the air conditioner.

The operation status parameters are a type of parameters corresponding to operation statuses of the air conditioner, for example, parameters of the air conditioner in different working modes, wherein the working modes may be a heating mode, a refrigeration mode, a static sleep mode, a fresh air mode, a dehumidification mode, a humidification mode and the like; or, for example, gear time coefficients of the air conditioner at different wind speed gears.

The air quality parameters refer to a type of parameters related to air quality, such as indoor temperature, indoor humidity, outdoor air quality index, indoor PM2.5 (Particulate Matter 2.5), outdoor PM2.5, etc.

The equivalent operation duration of the air conditioner is determined after determining to correct a total booting duration of the air conditioner based on the operation duration, operation status parameters and air quality parameters, and is different from the total booting duration of the air conditioner in the prior art. The total booting duration of the air conditioner in the prior art is a total operation duration of the air conditioner recorded by a system clock of the air conditioner.

A daily equivalent duration is not a daily booting duration of the air conditioner in the prior art, but is determined after correcting the operation duration of the air conditioner on that day according to the operation duration, operation status parameters and air quality parameters of the air conditioner on that day.

The operation wind speed gears of the air conditioner are preset gears in an air conditioning system, and generally include high, medium and low gears respectively corresponding to different wind speeds.

An indoor PM2.5 level is an air quality level determined according to an indoor PM2.5 value or an outdoor PM2.5 value.

The air time coefficients correspond to the indoor PM2.5 levels, so as to reflect influence of different indoor PM2.5 levels on dust accumulation of the heat exchanger or filter mesh of the air conditioner.

In the present disclosure, a local clock can be accurately synchronized with a time source through an NTP (Network Time Protocol) every day, i.e., every natural day, referring to 24 hours a day.

The method and the device for controlling self-cleaning of the air conditioner according to the present disclosure will be described below with specific embodiments.

FIG. 1 is a flow chart of a method for controlling self-cleaning of an air conditioner. As shown in FIG. 1, the method for controlling self-cleaning of the air conditioner includes:

step S101, operation duration, operation status parameters and air quality parameters of the air conditioner are acquired;

step S102, an equivalent operation duration of the air conditioner is determined according to the operation duration, operation status parameters and air quality parameters of the air conditioner; and step S103, the air conditioner is controlled to perform self-cleaning when the equivalent operation duration of the air conditioner is greater than a cleaning duration threshold value.

Optionally, in the step S102, the equivalent operation duration of the air conditioner may be determined in a preset data table according to the operation duration, operation status parameters and air quality parameters of the air conditioner; or, the equivalent operation duration of the air conditioner may be calculated according to the operation duration, operation status parameters and air quality parameters of the air conditioner.

The air quality parameters may correspond to a whole operation time period of the air conditioner for reflecting an average air quality of the whole operation time period, or may respectively correspond to different operation statuses of the air conditioner for reflecting the average air quality in time periods of different operation statuses.

Further, the equivalent operation duration of the air conditioner may be calculated according to the following formula:

$$T=\tau*(\alpha*t_1+\beta*t_2+\ldots+\gamma*t_n),$$

where $t_1, t_2, \ldots, t_n$ are the operation durations of the air conditioner in different operation statuses; $\alpha, \beta, \ldots, \gamma$ are the operation status parameters corresponding to different operation statuses; and $\tau$ is the air quality parameter for reflecting the average air quality in a whole operation time.

Optionally, the step of acquiring the air quality parameters in the step S101 includes:

an operation status of the air conditioner is monitored;

an outdoor air quality in a monitoring time period is acquired; and an air quality parameter is determined according to the outdoor air quality.

In the above embodiment, the air time coefficient may be determined in a manner of table lookup or calculation.

In a traditional solution for judging self-cleaning, merely the single variable of booting and operation duration of the air conditioner measured by the system block is used for judgment, but different operation environments and different operation statuses of the air conditioner may affect the dust accumulation of the air conditioner. For example, the higher a particulate matter content in the air in the operation environment is, the higher a dust accumulation speed of the air conditioner is. If the air conditioner keeps operating at a high speed, the dust accumulation speed of the air conditioner is also higher. In the above embodiment, the equivalent operation duration of the air conditioner determined by the operation duration, operation status parameters and air quality parameters of the air conditioner is different from the total booting duration of the air conditioner in the prior art. In addition to the operation duration, the operation status parameters and the air quality parameters need to be combined in a process of determining the equivalent operation duration of the air conditioner in the step S102. However, the operation status parameters reflect different operation statuses of the air conditioner during operation, and the air quality parameters reflect the indoor or outdoor air quality of the air conditioner during operation. Thus, three important parameters including the operation duration, operation status parameters and air quality parameters of the air conditioner are introduced into the embodiment in a process of judging whether to clean, thereby avoiding a problem of delayed cleaning or premature cleaning of the air conditioner which is caused by estimating a self-cleaning frequency merely according to the variable of booting duration in the traditional solution, improving use efficiency of the air conditioner, enhancing user experience, and making cleaning solutions smarter.

Figure 2:
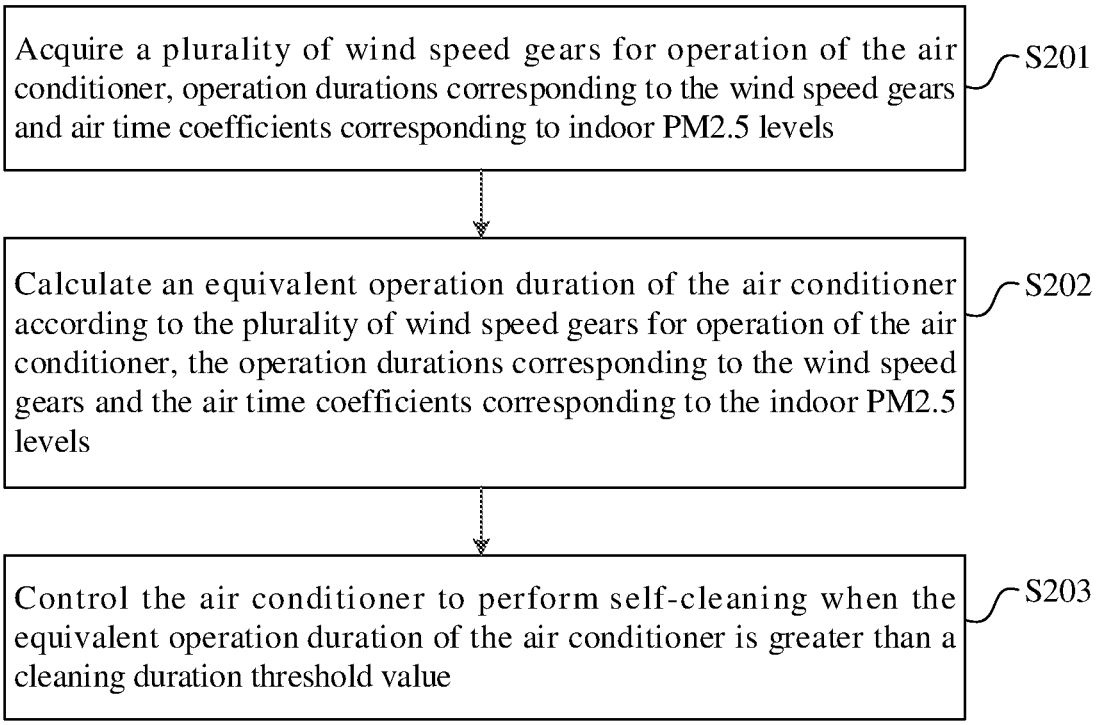
FIG. 2 is a flow chart of a method for controlling self-cleaning of an air conditioner according to one exemplary embodiment.

FIG. 2 illustrates the method for controlling self-cleaning of the air conditioner in FIG. 1 below. In FIG. 2, whether the air conditioner needs to perform self-cleaning is judged by acquiring the gear time coefficients of a plurality of wind speed gears for operation of the air conditioner, the operation durations corresponding to various wind speed gears and the air time coefficients corresponding to the indoor air quality levels, and calculating the equivalent operation duration of the air conditioner according to the above parameters. The indoor air quality levels refer to indoor PM2.5 levels. Specifically, step S201, the plurality of wind speed gears for operation of the air conditioner, the operation durations corresponding to the wind speed gears and the air time coefficients corresponding to the indoor PM2.5 levels are acquired;

step S202, the equivalent operation duration of the air conditioner is calculated according to the plurality of wind speed gears for operation of the air conditioner, the operation durations corresponding to the wind speed gears and the air time coefficients corresponding to the indoor PM2.5 levels; and step S203, the air conditioner is controlled to perform self-cleaning when the equivalent operation duration of the air conditioner is greater than a cleaning duration threshold value.

In the above embodiment, the air time coefficients corresponding to the indoor PM2.5 levels reflect conditions of the indoor air quality during operation of the air conditioner, and the air time coefficients are related to the operation time period of the air conditioner. In the above embodiment, a working status of the air conditioner may be continuously monitored, and then the equivalent operation duration of the air conditioner is calculated according to monitoring results in real time. Or, the operation parameters of the air conditioner are acquired every a fixed duration, and then the equivalent operation duration of the air conditioner is calculated according to the operation parameters of the air conditioner.

In some optional embodiments, the wind speed gears include high, medium and low gears. The step of calculating the equivalent operation duration of the air conditioner according to the operation parameters of the air conditioner includes:

calculating the equivalent operation duration T of the air conditioner according to the following formula:

$$T=\tau*(\alpha*t_H+\beta*t_M+\gamma*t_L),$$

where $\tau$ is the air time coefficients corresponding to the indoor PM2.5 levels; $\alpha$, $\beta$ and $\gamma$ are respectively the gear time coefficients when the wind speed gears are high, medium and low; and $t_H$, $t_M$ and $t_L$ are respectively the operation durations when the wind speed gears are high, medium and low.

It can be seen from the formula that $\tau$ corresponds to the whole operation time period of the air conditioner for reflecting the average indoor air quality in the whole operation time period. In the present embodiment, a calculation formula for calculating and correcting the equivalent operation duration of the air conditioner according to the plurality of wind speed gears for operation of the air conditioner, the operation durations corresponding to the wind speed gears and the air time coefficients corresponding to the indoor PM2.5 levels is given. $\alpha$, $\beta$ and $\gamma$ are respectively preset gear time coefficients corresponding to different wind speed gears. The gear time coefficients can be queried according to the different wind speed gears.

In some optional embodiments, the step of acquiring the operation parameters of the air conditioner includes:

the operation status of the air conditioner is monitored, and the operation durations of the air conditioner in different wind speed gears are recorded;

an average value of outdoor PM2.5 in a monitoring time period is acquired;

an indoor PM2.5 level is determined according to the average value of the outdoor PM2.5; and the air time coefficient corresponding to the indoor PM2.5 level is determined according to the indoor PM2.5 level.

In some optional embodiments, if the air conditioner is continuously operated in the monitoring time period, the cleaning duration threshold value is 240 hours; and if the air conditioner is intermittently operated in the monitoring time period, the cleaning duration threshold value is 264 hours.

In some optional embodiments, the method for calculating the equivalent operation duration of the air conditioner may be realized in two modes as follows.

A first mode is to count the equivalent operation duration of the air conditioner every a fixed time period since a last self-cleaning operation of the air conditioner, and specifically includes the following flows: after the air conditioner performs the self-cleaning operation, the system clock starts to calculate the number of days, every 5 days such as on a 6th day, an 11th day and a 16th day, and counts the equivalent operation duration of the air conditioner after 5 days, 10 days and 15 days since the air conditioner performs the self-cleaning operation. If the counted equivalent operation duration of the air conditioner is greater than the cleaning duration threshold value, the air conditioner performs the self-cleaning operation. If the counted equivalent operation duration of the air conditioner is less than the cleaning duration threshold value, the equivalent operation duration of the air conditioner is recorded to simplify the calculation amount of the next equivalent operation duration of the air conditioner.

A second mode is to calculate the equivalent operation duration of the air conditioner every day since the last self-cleaning operation of the air conditioner, and specifically includes the following flows: after the air conditioner is booted up for the first time every day (such as on an (n+1)th day), the operation parameters of the air conditioner on a last natural day (nth day), including the plurality of wind speed gears for operation of the air conditioner on the nth day, the operation durations corresponding to the wind speed gears and the air time coefficients corresponding to the indoor PM2.5 levels, are acquired; then, the daily equivalent duration on the nth day is calculated according to the acquired operation parameters; and the daily equivalent duration on the last day may be calculated every day, so after the daily equivalent duration on the nth day is calculated, the recorded daily equivalent durations from the last self-cleaning operation of the air conditioner to an (n−1)th day are taken and summed to calculate the equivalent operation duration of the air conditioner.

The first mode for calculating the equivalent operation duration of the air conditioner according to the preset fixed time period has a judging frequency relatively lower than that of the second mode, and is suitable for situations in which operation environments of the air conditioner are good, such as clean rooms, refrigeration rooms and the like with high perennial air cleanliness and relatively closed environments.

In the second mode, whether to perform self-cleaning is judged every day, so that the dust accumulation of the air conditioner may be known in time, and the corresponding self-cleaning operation may be performed to avoid degradation in performance of the air conditioner due to dust accumulation. To avoid repetition and a large amount of calculation and judgment, the judgment is performed only after the air conditioner is booted up for the first time every day. In addition, whether the air conditioner needs to perform self-cleaning every time is judged after monitoring operation of the air conditioner all day, rather than when the air conditioner is operating. A manner of judging while operating is feasible, but such a manner may cause overload of operation of a terminal in which the method is used.

Optionally, in the second mode, if the air conditioner is continuously used without shutdown from the nth day to the (n+1)th day, acquiring of the operation parameters of the air conditioner on the nth day is triggered when 0 o'clock of the (n+1)th day is past according to the system clock, and the daily equivalent duration on the nth day is calculated, thereby calculating the equivalent operation duration of the air conditioner. The method avoids a situation that the self-cleaning cannot be judged caused by that the air conditioner continuously operates across days.

If the air conditioner calculates the total operation duration of the air conditioner after being booted up for the first time, the cleaning duration threshold value is 240 h. If the air conditioner continuously operates across days, the total operation duration of the air conditioner is calculated after the system clock is over 0 o'clock, and the cleaning duration threshold value is 264 h.

In some illustrative embodiments, if the daily operation parameters of the air conditioner since the last self-cleaning operation of the air conditioner are acquired in the above embodiment, i.e., the equivalent operation duration of the air conditioner since the last self-cleaning operation of the air conditioner needs to be calculated once on every natural day, then, the step S102 includes:

the daily equivalent durations are calculated according to the daily operation parameters of the air conditioner since the last self-cleaning operation of the air conditioner; and the calculated daily equivalent durations are summed to obtain the equivalent operation duration of the air conditioner.

Specifically, the operation parameters of the air conditioner in n days since the last self-cleaning operation of the air conditioner are acquired, wherein n is an integer greater than 1.

The operation for calculating the equivalent operation duration of the air conditioner according to the daily operation parameters of the air conditioner since the last self-cleaning operation of the air conditioner includes:

the daily operation durations of the air conditioner in n days since the last self-cleaning operation of the air conditioner are calculated according to a formula 1, and are respectively $T_1, T_2, \ldots, T_n$, wherein $T_n$ is the operation duration on the nth day. The formula 1 is:

$$T_n=\tau_n*(\alpha*t_{Hn}+\beta*t_{Mn}+\gamma*t_{Ln}),$$

where $\tau_n$ is the air time coefficient corresponding to the indoor PM2.5 level on the nth day; α, β and γ are respectively the gear time coefficients when the wind speed gears are high, medium and low; and $t_{Hn}$, $t_{Mn}$ and $t_{Ln}$ are respectively the operation durations on the nth day when the wind speed gears are high, medium and low.

The calculated operation durations $T_1, T_2, \ldots, T_n$ in the n days are summed to obtain the equivalent operation duration of the air conditioner.

In the above embodiment, the air time coefficients may be acquired from a cloud server or other devices, and may also be determined according to an average value of PM2.5 values throughout the day of a place where the air conditioner is located.

During operation of the air conditioner, wind speeds of the air conditioner and operation durations of different wind speeds are main factors of a dust accumulation speed of the air conditioner. Furthermore, different indoor PM2.5 values are also the main factor affecting the dust accumulation speed. The indoor PM2.5 is the particulate matter with an aerodynamic equivalent diameter less than or equal to 2.5 μm in indoor environment air, but various institutions and environment monitoring platforms monitor the outdoor PM2.5 much more at present. An indoor unit of the air conditioner is mainly used for ventilation and blowing of indoor air, so the dust accumulation of the air conditioner is judged according to the indoor PM2.5. Optionally, the indoor PM2.5 may be self-monitored or acquired from other terminals or cloud servers.

If the air time coefficient is determined according the average value of PM2.5 values throughout the day of the place where the air conditioner is located, the processes may be as follows:

the average value of PM2.5 values throughout the day of the place where the air conditioner is located is acquired;

the indoor PM2.5 level is determined by querying a database according to the average value of PM2.5 values throughout the day of the place where the air conditioner is located; and further, the air time coefficient corresponding to the indoor PM2.5 level is determined according to the indoor PM2.5 level in the database.

The database stores different indoor PM2.5 levels, a range of the indoor PM2.5 values corresponding to various levels, and the air time coefficients corresponding to various levels.

Further, the step of determining the indoor PM2.5 level by querying a database according to the average value of PM2.5 values throughout the day of the place where the air conditioner is located includes:

the average value of the indoor PM2.5 is calculated according to the following formula 2; and the indoor PM2.5 level is determined according to a range querying database for indoor PM2.5 evaluation values.

$$PM2.5\text{indoor}=K*PM2.5\text{outdoor} \quad (2),$$

wherein PM2.5outdoor is the average value of outdoor PM2.5, and PM2.5indoor is the average value of indoor PM2.5. Further, 0<K<1, K is determined by big data analysis and multiple experiments, and the value of K is 0.75 in home environments.

The average value of the PM2.5 values throughout the day of the place where the air conditioner is located is acquired from a network side. The network side, such as a server where the national air quality monitoring center is located, monitors and counts PM2.5 data across the country in real time.

Structure and information of the database may be shown in Table 1.

TABLE 1

Structure and Information of Database

| | Indoor PM2.5 level | | | | | |
|---|---|---|---|---|---|---|
| | Level 1 | Level 2 | Level 3 | Level 4 | Level 5 | Level 6 |
| Indoor PM2.5 level Value range (μg/m³) | 0-50 | 51-100 | 101-150 | 151-200 | 201-300 | >300 |
| Air time coefficient | 1 | 1.2 | 1.3 | 1.4 | 1.5 | 1.6 |
| Wind speed gear | High | | Medium | | Low | |
| Gear time coeffieint | 1.5 | | 1 | | 0.8 | |

The process of calculating the operation duration on the nth day will be illustrated below in combination with Table 1 and the formula 1.

See Table 2 for the acquired operation parameters of the air conditioner on nth day.

TABLE 2

Operation Parameters of Air Conditioner on nth Day

| | Wind speed gear | | |
|---|---|---|---|
| | High | Medium | Low |
| Operation duration of nth day | 2 hours | 5 hours | 3 hours |
| Outdoor PM2.5 (μg/m³) | | 210 | |

According to Table 1 and Table 2, the following parameter values may be determined:

The outdoor PM2.5 is 210 μg/m³, which can be substituted into the formula 2 to calculate that the indoor PM2.5 is 157.5 μg/m³.

$\tau_n$=1.4, α=1.5, β=1, γ=0.8, $t_{Hn}$=2 h, $t_{Mn}$=5 h, and $t_{Ln}$=3 h.

The above values may be substituted into the formula 1 to calculate the operation duration of the air conditioner on the nth day $T_n$=14.6 h. It can be seen from the present embodiment that an actual operation duration of the air conditioner on the nth day is 10 h, but since the outdoor PM2.5 is up to 210 μg/m³, the daily equivalent duration on the nth day calculated by the formula 1 is 14.6 h.

After the daily equivalent duration on the nth day is calculated, all the daily equivalent durations on the (1−n)th day after the self-cleaning of the air conditioner are summed to calculate the equivalent operation duration of the air conditioner. The equivalent operation duration of the air conditioner is compared with the cleaning duration threshold value; and if it is greater than the cleaning duration threshold value, the air conditioner needs to perform self-cleaning.

Figure 3:
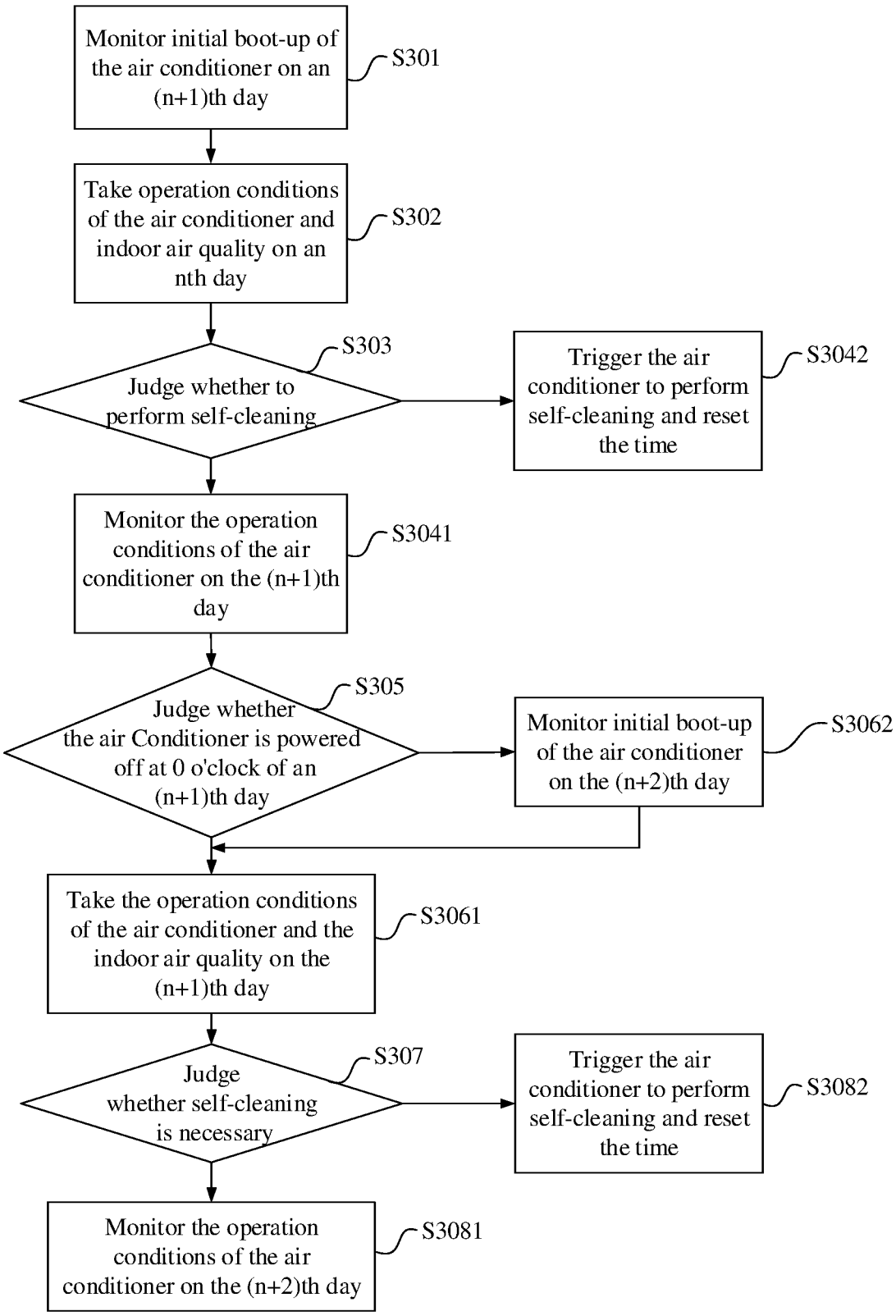
FIG. 3 is a flow chart of a method for controlling self-cleaning of an air conditioner according to one exemplary embodiment.

For detailed and specific description of the embodiments shown in FIG. 1 and FIG. 2, FIG. 3 is a schematic diagram of a specific flow of the method for controlling self-cleaning of the air conditioner shown in the above embodiments. Monitoring, storage and judgment for a series of data are involved in the present embodiment, so the processes may be executed by a smart air conditioner or a mobile application (APP) or a cloud server bound to the air conditioner. The above processes are usually not configured to the air conditioner in a traditional home environment to avoid overload of the air conditioner. In addition, the terminal where the APP is located is usually not suitable for storing and calculating a large amount of data. Therefore, the present embodiment may be completed by the cloud server; and the cloud server may directly communicate with the air conditioner or control the air conditioner through the mobile APP.

It is assumed that an executive subject of the present embodiment is the cloud server. The cloud server may monitor daily operation conditions of the air conditioner since a last cleaning of the air conditioner and judge whether the air conditioner needs to perform self-cleaning when the air conditioner is booted up for the first time every day. Specific implementation processes may refer to FIG. 3.

Step S301, on the (n+1)th day, the number of days is counted from the day after the last cleaning, and initial boot-up of the air conditioner is monitored.

In the step, the process of monitoring the initial boot-up of the air conditioner may indicate that the APP notifies the cloud server after monitoring boot-up of the air conditioner or automatically notifies the cloud server after powering on the air conditioner.

Step S302, the operation conditions of the air conditioner and the indoor air quality on the nth day are taken.

Since the cloud server may monitor the air conditioner every day, the cloud server may take the operation conditions of the air conditioner monitored on the nth day at the beginning of boot-up on the (n+1)th day, query the average value of the outdoor air quality within 24 h on the nth day, and determine the indoor air quality according to the average value.

Step S303, whether to perform self-cleaning is judged.

A specific solution for how to judge self-cleaning by the operation conditions of the air conditioner and the indoor air quality is given below.

Figure 4:
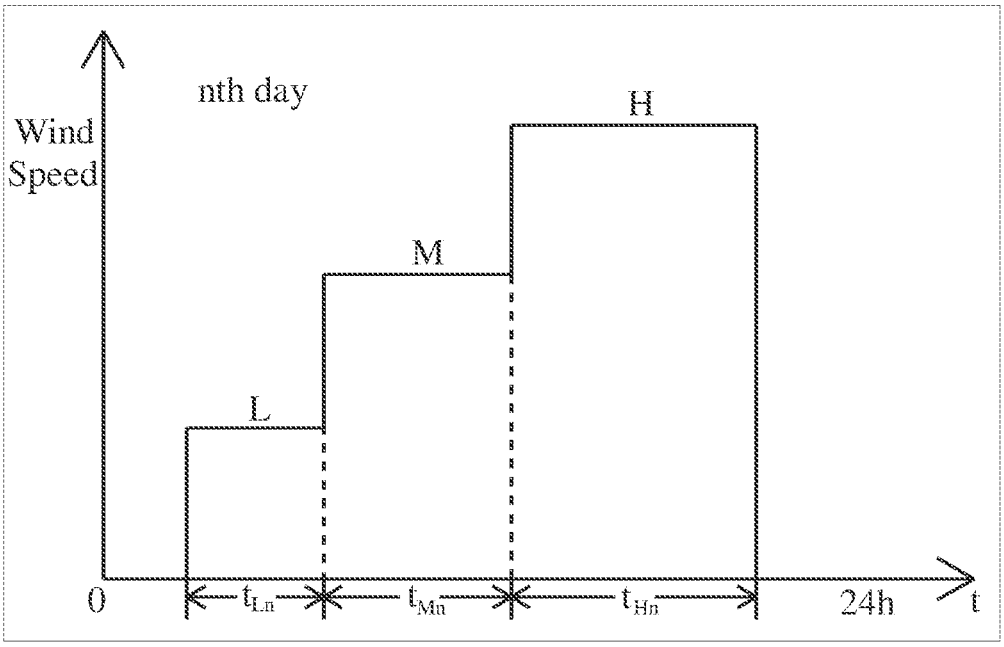
FIG. 4 is a diagram of operation durations of an air conditioner under different wind speed gears monitored on nth day according to one exemplary embodiment.

FIG. 4 shows results of monitoring the operation conditions of the air conditioner on the nth day. Conditions that the air conditioner uses different wind speed gears (low wind L, medium wind M and high wind H) in one day and the counted operation durations $t_{Hn}$, $t_{Mn}$ and $t_{Ln}$ corresponding to various wind speed gears are recorded in the FIG. 4.

The cloud server queries the average value PM2.5outdoor of outdoor PM2.5 throughout the day of a place where the air conditioner is located on the nth day, and then determines the average value PM2.5indoor of the indoor PM2.5 according to the PM2.5outdoor and a preset conversion coefficient K as shown in the formula 2.

$$PM2.5\text{indoor}=K*PM2.5\text{outdoor} \quad (2),$$

where 0<K<1.

The cloud server queries a corresponding time coefficient $\tau_n$ according to the indoor PM2.5 level corresponding to the PM2.5indoor after the PM2.5indoor is acquired, and then calculates the daily equivalent duration $T_n$ on the nth day according to the formula 1 mentioned in the above embodiment:

$$T_n=\tau_n*(\alpha*t_{Hn}+\beta*t_{Mn}+\gamma*t_{Ln}), \quad (1),$$

where α, β and γ are respectively the time coefficients corresponding to the three wind speed gears of H, M and L; α, β and γ are preset; and α>β>γ>0.

Then, the total operation duration $$\sum_{i=m}^{n} T_i$$

of the air conditioner within n days after the last cleaning is calculated according to a formula 3:

$$\sum_{i=m}^{n} T_i = T_m + T_{m+1} + +T_{n-1} + T_n. \quad (3)$$

In the formula (3), m is the first day after the last self-cleaning of a user.

On the (n+1)th day, when the air conditioner is booted up for the first time, the value of $$\sum_{i=m}^{n} T_i$$

is compared with the preset cleaning time threshold value, such as 240 h, to judge:

Step S3041, if it is judged in the step S203 that self-cleaning is not required, the operation conditions of the air conditioner on the (n+1)th day are monitored.

For example, if $$\sum_{i=m}^{n} T_i \leq 240h,$$

the self-cleaning is not required, and the cloud server does not push the APP to prompt.

Step S3042, if it is judged in step S303 that the self-cleaning is required, the air conditioner is triggered to perform self-cleaning.

The specific operation may be as follows: if $$\sum_{i=m}^{n} T_i \leq 240h,$$

the cloud server prompts the air conditioner to perform self-cleaning through the APP;

or the cloud server directly sends a control command to the air conditioner.

Step S305, whether the air conditioner is powered off is judged at 0 o'clock on an (n+2)th day. During actual use of the air conditioner, since a problem of continuous use of the air conditioner exists, a judgment step is added herein to avoid a problem that the cloud server cannot be accurately triggered to calculate the operation conditions of the air conditioner on the previous day and judge whether to clean due to continuous use of the air conditioner.

Step S3061, if it is judged in the step S305 that the air conditioner is not powered off, the operation conditions of the air conditioner and the indoor air quality on the (n+1)th day are taken; and a step S307, i.e., the flow of judging whether to perform self-cleaning, is performed.

Step S3062, if it is judged in the step S305 that the air conditioner has been powered off, a step S307 is triggered after the air conditioner is started for the first time on this day (the (n+2)th day). The flows of the subsequent steps S307, S3081 and S3082 are similar to the flows of the foregoing corresponding steps S303, S3041 and S3042, and are not repeated herein.

The present disclosure also provides a device for controlling self-cleaning of the air conditioner.

Figure 5:
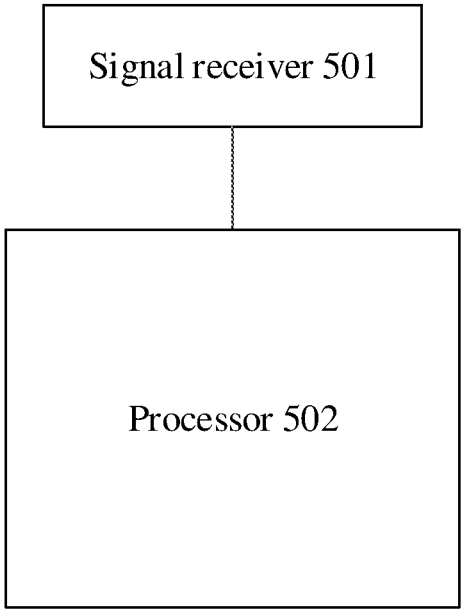
FIG. 5 is a structural block diagram of a device for controlling self-cleaning of an air conditioner according to one exemplary embodiment.

FIG. 5 shows a structural block diagram of the device for controlling self-cleaning of the air conditioner according to the embodiment of the present disclosure. As shown in FIG. 5, in some exemplary embodiments, the device includes:

a signal receiver 501, configured to acquire an operation duration, operation status parameters and air quality parameters of the air conditioner;

a processor 502, configured to determine an equivalent operation duration of the air conditioner according to the operation duration, operation status parameters and air quality parameters of the air conditioner, and control the air conditioner to perform self-cleaning when the equivalent operation duration of the air conditioner is greater than a cleaning duration threshold value.

Optionally, the processor 502 may determine the equivalent operation duration of the air conditioner in a preset data table according to the operation duration, operation status parameters and air quality parameters of the air conditioner, or calculate the equivalent operation duration of the air conditioner according to the operation duration, operation status parameters and air quality parameters of the air conditioner.

The air quality parameters may correspond to a whole operation time period of the air conditioner for reflecting an average air quality of the whole operation time period, or may respectively correspond to different operation statuses of the air conditioner for reflecting the average air quality in time periods of different operation statuses.

In some optional embodiments, the operation status parameters include gear time coefficients of a plurality of wind speed gears for operation of the air conditioner.

In some optional embodiments, the air quality parameters include an air time coefficient corresponding to an indoor air quality level.

In some optional embodiments, the operation duration includes operation durations corresponding to various wind speed gears.

In some optional embodiments, the wind speed gears include high, medium and low gears.

The processor is further configured to calculate the equivalent operation duration T of the air conditioner according to the following formula:

$$T=\tau*(\alpha*t_H+\beta*t_M+\gamma*t_L),$$

where $\tau$ is the air time coefficient corresponding to the air quality level; $\alpha$, $\beta$ and $\gamma$ are respectively the gear time coefficients when the wind speed gears are high, medium and low; and $t_H$, $t_M$ and $t_L$ are respectively the operation durations when the wind speed gears are high, medium and low.

In some optional embodiments, the processor 502 is further configured to monitor an operation status of the air conditioner, acquire an outdoor air quality in a monitoring time period, and determine an air quality parameter according to the outdoor air quality.

Further, the processor 502 may determine the air time coefficient in a manner of table lookup or calculation.

Three important parameters including the operation duration, operation status parameters and air quality parameters of the air conditioner are introduced into the device in a process of judging whether to clean, thereby avoiding a problem of delayed cleaning or premature cleaning of the air conditioner which is caused by estimating a self-cleaning frequency merely according to one variable which is a booting duration in a traditional solution, improving use efficiency of the air conditioner, enhancing user experience, and making cleaning solutions smarter.

Figure 6:
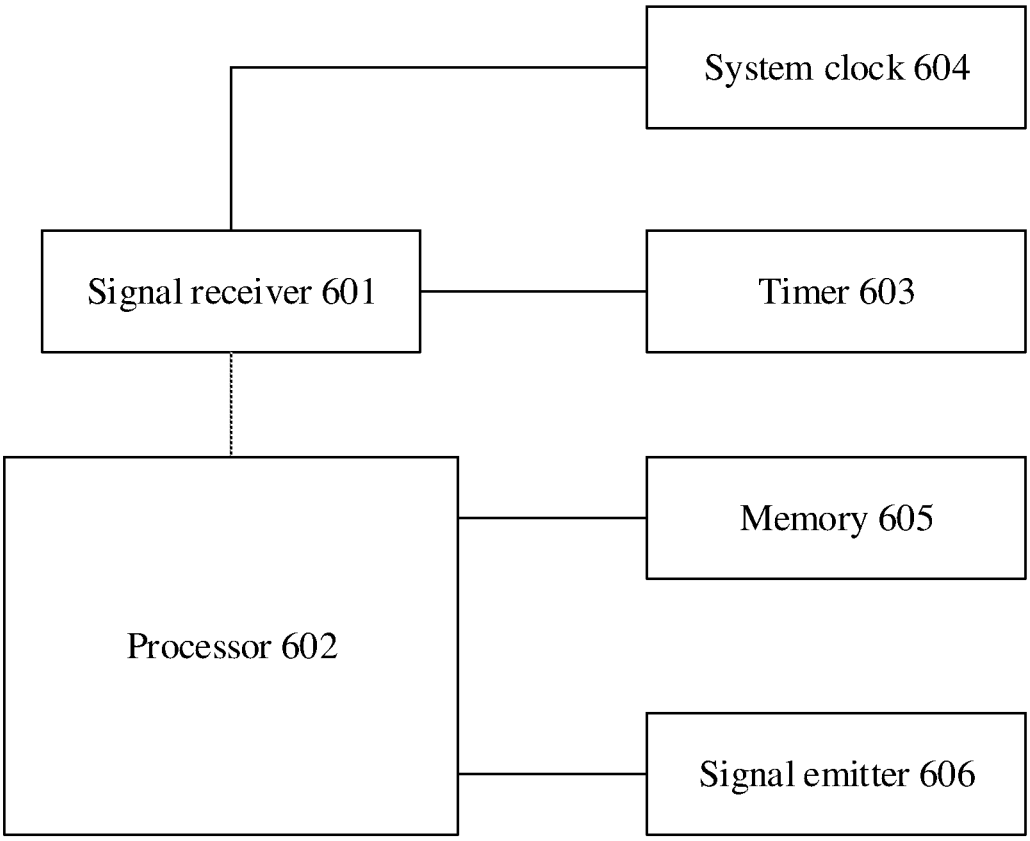
FIG. 6 is a structural block diagram of a device for controlling self-cleaning of an air conditioner according to one exemplary embodiment.

For detailed description of the device for controlling self-cleaning of the air conditioner, FIG. 6 gives a specific execution mode of the device for controlling self-cleaning of the air conditioner according to the above embodiment. As shown in FIG. 6, the device for controlling self-cleaning of the air conditioner includes:

a signal receiver 601, configured to receive the daily operation parameters of the air conditioner since the last self-cleaning operation of the air conditioner, wherein the operation parameters include the plurality of wind speed gears for operation of the air conditioner, operation durations corresponding to the wind speed gears and air time coefficients corresponding to indoor PM2.5 levels; and a processor 602, configured to calculate the equivalent operation duration of the air conditioner according to the daily operation parameters of the air conditioner since the last self-cleaning operation of the air conditioner sent by the signal receiver, compare the equivalent operation duration of the air conditioner with a preset cleaning duration threshold value, and judges that the air conditioner needs to perform self-cleaning if the equivalent operation duration of the air conditioner is greater than the cleaning duration threshold value.

Three important parameters including the plurality of wind speed gears for operation of the air conditioner, operation durations corresponding to the wind speed gears and air time coefficients corresponding to indoor PM2.5 levels are introduced into the device in a process of judging whether to clean, thereby avoiding a problem of delayed cleaning or premature cleaning of the air conditioner which is caused by estimating the self-cleaning frequency merely according to one variable which is a booting duration in a traditional solution, improving use efficiency of the air conditioner, enhancing user experience, and making cleaning solutions smarter.

In some optional embodiments, the processor 602 is further configured to calculate the daily operation duration of the air conditioner according to the daily operation parameters of the air conditioners since the last self-cleaning operation of the air conditioner, and calculate the equivalent operation duration of the air conditioner by summing the calculated daily operation durations of the air conditioner.

Further, the process that the processor 602 calculates the equivalent operation duration of the air conditioner may be as follows:

the device for controlling self-cleaning of the air conditioner further includes a timer 603.

The timer 603 is configured to perform a timing operation.

In some optional embodiments, the timer 603 is configured to calculate the number of days since the last self-cleaning operation of the air conditioner, and send a triggering signal to the signal receiver 601 every fixed number of days.

The signal receiver 601 is further configured to acquire the daily operation parameters of the air conditioners since the last self-cleaning operation of the air conditioner after receiving the triggering signal sent by the timer 603, wherein the operation parameters include the plurality of wind speed gears for operation of the air conditioner, operation durations corresponding to the wind speed gears and air time coefficients corresponding to indoor PM2.5 levels.

The processor 602 calculates the total operation duration of the air conditioner after receiving the operation parameters sent by the signal receiver 601, and performs an operation of judging self-cleaning.

In the above process, the fixed number of days is preset, such as 5 days. The device for controlling self-cleaning of the air conditioner counts the total operation duration of the air conditioner after 5 days, 10 days and 15 days since the air conditioner performs the self-cleaning operation every 5 days, such as on a 6th day, an 11th day and a 16th day since the air conditioner performs the self-cleaning operation. If the counted equivalent operation duration of the air conditioner is greater than the cleaning duration threshold value, the air conditioner performs the self-cleaning operation. If the counted equivalent operation duration of the air conditioner is less than the cleaning duration threshold value, the equivalent operation duration of the air conditioner is recorded in a memory 605 to simplify the calculation amount of the next equivalent operation duration of the air conditioner. During calculation of the next equivalent operation duration of the air conditioner, the equivalent operation duration of the air conditioner may be obtained by merely calculating the operation duration of the air conditioner within uncounted time and adding with the counted daily equivalent durations.

The device for controlling self-cleaning of the air conditioner according to the above embodiment for calculating the equivalent operation duration of the air conditioner according to the preset fixed time period has a relatively lower judging frequency, and is suitable for situations in which operation environments of the air conditioner are good, such as clean rooms, refrigeration rooms and the like with high perennial air cleanliness and relatively closed environments.

In some optional embodiments, the device for controlling self-cleaning of the air conditioner further includes: a system clock 604.

The system clock 604 is configured to accurately synchronize a local clock with a time source.

The signal receiver 601 is further configured to acquire the operation parameters of the air conditioner on the last natural day (nth day) after receiving an initial boot-up signal of the air conditioner (for example, on the (n+1)th day), wherein the operation parameters include the plurality of wind speed gears for operation of the air conditioner on the nth day, operation durations corresponding to the wind speed gears and air time coefficients corresponding to the indoor PM2.5 levels.

The processor 602 is further configured to calculate the daily equivalent duration of the nth day according to the acquired operation parameters.

In the above embodiment, since the processor 602 calculates the daily equivalent duration of the previous day every day, the processor 602 takes the daily equivalent durations from the last self-cleaning operation of the air conditioner to the (n−1)th day recorded in the memory 605 after calculating the daily equivalent duration of the nth day, and calculates the equivalent operation duration of the air conditioner by summing.

The device for controlling self-cleaning of the air conditioner in the above embodiment may judge whether to perform self-cleaning every day, so that the dust accumulation of the air conditioner may be known in time, and the corresponding self-cleaning operation may be performed to avoid degradation in performance of the air conditioner due to dust accumulation.

In addition, to avoid repetition and a large amount of calculation and judgment, the device for controlling self-cleaning of the air conditioner only performs judgment after the air conditioner is booted up for the first time every day. The device for controlling self-cleaning of the air conditioner judges whether the air conditioner needs to perform self-cleaning every time after monitoring operation of the air conditioner all day, rather than when the air conditioner is operating. A manner of judging while operating is feasible, but such a manner may cause overload of operation of a terminal in which the method is used.

Further, if the air conditioner is continuously used without shutdown from the nth day to the (n+1)th day, the signal receiver 601 is triggered to acquire the operation parameters of the air conditioner on the nth day when the system clock 604 monitors that 0 o'clock of the (n+1)th day is past; and then the processor 602 is triggered to calculate the operation duration of the air conditioner on the nth day, thereby determining the equivalent operation duration of the air conditioner. Thus, a situation that the self-cleaning cannot be judged caused by that the air conditioner continuously operates across days is avoided.

If the air conditioner calculates the total operation duration of the air conditioner after being booted up for the first time, the cleaning duration threshold value is 240 h. If the air conditioner continuously operates across days, the total operation duration of the air conditioner is calculated after the system clock passes 0 o'clock, and the cleaning duration threshold value is 264 h.

In some optional embodiments.

the signal receiver 602 is further configured to acquire the operation parameters of the air conditioner in n days since the last self-cleaning operation of the air conditioner, wherein n is an integer greater than 1.

The processor 602 is further configured to calculate the daily operation durations, including $T_1, T_2, \ldots, T_n$, of the air conditioner in n days since the last self-cleaning operation of the air conditioner according to a formula 1, and sum the operation durations $T_1, T_2, \ldots, T_n$ of the air conditioner in n days to obtain the equivalent operation duration of the air conditioner, wherein $T_n$ is the operation duration on the nth day. The formula 1 is:

$$T_n=\tau_n*(\alpha*t_{Hn}+\beta*t_{Mn}+\gamma*t_{Ln}),$$

where $\tau_n$ is the air time coefficient corresponding to the indoor PM2.5 on the nth day; $\alpha$, $\beta$ and $\gamma$ are respectively the gear time coefficients when the wind speed gears are high, medium and low; and $t_{Hn}$, $t_{Mn}$ and $t_{Ln}$ are respectively the operation durations on the nth day when the wind speed gears are high, medium and low.

In the above embodiment, the air time coefficients may be acquired by the signal receiver 601 from a cloud server or other devices, and may also be determined according to an average value of PM2.5 values throughout the day of a place where the air conditioner is located.

During operation of the air conditioner, wind speeds of the air conditioner and operation durations of different wind speeds are main factors of a dust accumulation speed of the air conditioner. Furthermore, different indoor PM2.5 is also the main factor that affects the dust accumulation speed. The indoor PM2.5 is the particulate matter with an aerodynamic equivalent diameter less than or equal to 2.5 μm in indoor environment air, but various institutions and environment monitoring platforms monitor the outdoor PM2.5 much more at present. An indoor unit of the air conditioner is mainly used for ventilation and blowing of indoor air, so the dust accumulation of the air conditioner is judged according to the indoor PM2.5. Optionally, the indoor PM2.5 may be self-monitored or obtained from other terminals or cloud servers.

In some optional embodiments, the signal receiver 601 is further configured to receive the average value of PM2.5 values throughout the day of the place where the air conditioner is located.

The processor 602 is further configured to determine the indoor PM2.5 level by querying a database stored in the memory 605 according to the average value of PM2.5 values sent by the signal receiver throughout the day of the place where the air conditioner is located, and determine the air time coefficient corresponding to the indoor PM2.5 level according to the indoor PM2.5 level.

The database records different indoor PM2.5 levels, a range of the indoor PM2.5 values corresponding to various levels, and the air time coefficients corresponding to various levels.

Further, the processor 602 is further configured to calculate the average value of the indoor PM2.5 according to the following formula 2, and determine the indoor PM2.5 level according to a range querying database for indoor PM2.5 evaluation values.

$$PM2.5\text{indoor}=K*PM2.5\text{outdoor} \quad (2),$$

wherein PM2.5outdoor is the average value of outdoor PM2.5, and PM2.5indoor is the average value of indoor PM2.5. Further, $0<K<1$, K is determined by big data analysis and multiple experiments, and the value of K is 0.75 in home environments.

The average value of the PM2.5 values throughout the day of the place where the air conditioner is located is acquired from a network side. The network side, such as a server where the national air quality monitoring center is located, monitors and counts PM2.5 data across the country in real time.

The structure and information of the above database may be shown in Table 1.

In some optional embodiments, the processor 602 is further configured to generate a self-cleaning control signal after judging that the air conditioner needs to perform self-cleaning.

Optionally, the device for controlling self-cleaning of the air conditioner further includes:

a signal emitter 606, configured to receive the self-cleaning control signal sent by the processor 602 and send the signal to the air conditioner.

It should be understood that the present disclosure is not limited to the processes and structures described above and shown in the accompanying drawings, and can be subjected to various modifications and changes without departing from the scope thereof. The scope of the present disclosure is limited only by appended claims.

The invention claimed is:

1. A method for controlling self-cleaning of an air conditioner, comprising:

acquiring operation duration, operation status parameters and air quality parameters of the air conditioner, wherein at least some of the operation status parameters vary with a working mode of the air conditioner;

determining an equivalent operation duration of the air conditioner according to the operation duration, the operation status parameters and the air quality parameters of the air conditioner, wherein the equivalent operation duration of the air conditioner is determined according to at least one of two modes, further wherein at least one mode operates as follows:

determining that the air conditioner has started for a first time on a day, acquiring the operation duration, the operation status parameters, and the air quality parameters from a previous day, calculating a daily equivalent operation duration for the previous day, and determining the equivalent operation duration based on at least the daily equivalent operation duration; and controlling the air conditioner to perform self-cleaning when the equivalent operation duration of the air conditioner is greater than a cleaning duration threshold value.

2. The method according to claim 1, wherein the operation status parameters comprise: gear time coefficients of a plurality of wind speed gears for operation of the air conditioner.

3. The method according to claim 2, wherein the air quality parameters comprise: an air time coefficient corresponding to an indoor air quality level.

4. The method according to claim 3, wherein the acquiring the air quality parameters comprise:

monitoring an operation status of the air conditioner;

acquiring an outdoor air quality in a monitoring time period; and determining an indoor air quality parameter according to the outdoor air quality.

5. The method according to claim 2, wherein the operation duration comprises: operation durations corresponding to the plurality of wind speed gears.

6. The method according to claim 5, wherein the wind speed gears comprise high, medium and low gears; the determining the equivalent operation duration of the air conditioner according to the operation duration, the operation status parameters and the air quality parameters of the air conditioner comprises:

determining the equivalent operation duration T of the air conditioner according to the following formula:

$$T=\tau(\alpha t_H+\beta t_M+\gamma t_L),$$

wherein the $\tau$ is the air time coefficient corresponding to the air quality level; the $\alpha$, $\beta$ and $\gamma$ are respectively the gear time coefficients when the wind speed gears are high, medium and low; and the $t_H$, $t_M$ and $t_L$ are respectively the operation durations when the wind speed gears are high, medium and low.

7. The method according to claim 6, wherein the acquiring the air quality parameters comprise:

monitoring an operation status of the air conditioner;

acquiring an outdoor air quality in a monitoring time period; and determining an indoor air quality parameter according to the outdoor air quality.

8. The method according to claim 5, wherein the acquiring the air quality parameters comprise:

monitoring an operation status of the air conditioner;

acquiring an outdoor air quality in a monitoring time period; and determining an indoor air quality parameter according to the outdoor air quality.

9. The method according to claim 2, wherein the acquiring the air quality parameters comprise:

monitoring an operation status of the air conditioner;

acquiring an outdoor air quality in a monitoring time period; and determining an indoor air quality parameter according to the outdoor air quality.

10. The method according to claim 1, wherein the acquiring the air quality parameters comprise:

monitoring an operation status of the air conditioner;

acquiring an outdoor air quality in a monitoring time period; and determining an indoor air quality parameter according to the outdoor air quality.

11. The device according to claim 1, wherein the working mode of the air conditioner may include at least one of: (i) a heating mode, (ii) a refrigeration mode, (iii) a static sleep mode, (iv) a fresh air mode, (v) a dehumidification mode, or (vi) a humidification mode.

12. A device for controlling self-cleaning of an air conditioner, comprising:

a signal receiver, configured to acquire an operation duration, operation status parameters and air quality parameters of the air conditioner; and a processor, configured to:

determine an equivalent operation duration of the air conditioner according to the operation duration, operation status parameters and air quality parameters of the air conditioner, and control the air conditioner to perform self-cleaning when the equivalent operation duration of the air conditioner is greater than a cleaning duration threshold value, wherein at least some of the operation status parameters vary with a working mode of the air conditioner, and further wherein the equivalent operation duration of the air conditioner is determined according to at least one of two modes, further wherein at least one mode operates as follows:

determining that the air conditioner has started for a first time on a day, acquiring the operation duration, the operation status parameters, and the air quality parameters from a previous day, calculating a daily equivalent operation duration for the previous day, and determining the equivalent operation duration based on at least the daily equivalent operation duration.

13. The device according to claim 12, wherein the operation status parameters comprise: gear time coefficients of a plurality of wind speed gears for operation of the air conditioner.

14. The device according to claim 13, wherein the air quality parameters comprise: an air time coefficient corresponding to an indoor air quality level.

15. The device according to claim 14, wherein the processor is further configured to monitor an operation status of the air conditioner, acquire an outdoor air quality in a monitoring time period, and determine the air quality parameter according to the outdoor air quality.

16. The device according to claim 13, wherein the operation duration comprises: operation durations corresponding to the plurality of wind speed gears.

17. The device according to claim 16, wherein the wind speed gears comprise high, medium and low gears;

the processor is further configured to calculate the equivalent operation duration T of the air conditioner according to the following formula:

$$T=\tau(\alpha t_H+\beta t_M+\gamma t_L),$$

wherein the T is the air time coefficient corresponding to the air quality level; the $\alpha$, $\beta$ and $\gamma$ are respectively the gear time coefficients when the wind speed gears are high, medium and low; and the $t_H$, $t_M$ and $t_L$ are respectively the operation durations when the wind speed gears are high, medium and low.

18. The device according to claim 17, wherein the processor is further configured to monitor an operation status of the air conditioner, acquire an outdoor air quality in a monitoring time period, and determine the air quality parameter according to the outdoor air quality.

19. The device according to claim 16, wherein the processor is further configured to monitor an operation status of the air conditioner, acquire an outdoor air quality in a monitoring time period, and determine the air quality parameter according to the outdoor air quality.

20. The device according to claim 13, wherein the processor is further configured to monitor an operation status of the air conditioner, acquire an outdoor air quality in a monitoring time period, and determine the air quality parameter according to the outdoor air quality.

21. The device according to claim 12, wherein the processor is further configured to monitor an operation status of the air conditioner, acquire an outdoor air quality in a monitoring time period, and determine the air quality parameter according to the outdoor air quality.

* * * * *